US008636318B2

(12) United States Patent
Newsome

(10) Patent No.: US 8,636,318 B2
(45) Date of Patent: Jan. 28, 2014

(54) LOUNGE CHAIR EQUIPPED FOR FACE DOWN LOUNGING

(76) Inventor: Timothy W. Newsome, Palos Heights, IL (US)

( * ) Notice: Subject to any disclaimer, the term of this patent is extended or adjusted under 35 U.S.C. 154(b) by 238 days.

(21) Appl. No.: 13/206,654

(22) Filed: Aug. 10, 2011

(65) Prior Publication Data

US 2013/0038096 A1 Feb. 14, 2013

(51) Int. Cl.
*A47C 7/62* (2006.01)

(52) U.S. Cl.
USPC ..... 297/188.08; 297/900; 5/110

(58) Field of Classification Search
USPC ..... 297/354.13, 188.06, 188.08; 5/110, 111
See application file for complete search history.

(56) References Cited

U.S. PATENT DOCUMENTS 3,897,102 A * 7/1975 Lemaire ..... 297/452.13 X
D352,635 S 11/1994 Yoder
5,926,871 A 7/1999 Howard
5,946,749 A * 9/1999 Sewell ..... 297/188.08 X
6,059,365 A 5/2000 Diamond
6,068,342 A 5/2000 Mariani et al.
6,935,694 B2 8/2005 Turner
6,938,287 B1 9/2005 Mahshie
7,959,222 B1 * 6/2011 Powell et al. ..... 297/188.06 X
2002/0079731 A1 6/2002 Sisti
2005/0262641 A1 12/2005 Maslyar
2006/0005313 A1 1/2006 Fluellen
2006/0230536 A1 10/2006 Friedman et al.

* cited by examiner

*Primary Examiner* — Anthony D Barfield
(74) *Attorney, Agent, or Firm* — Dale J. Ream

(57) ABSTRACT

A lounge chair equipped for lounging face down includes a frame having opposed top and bottom ends and opposed side rails extending longitudinally therebetween, the frame including lower, middle, and upper sections. A plurality of spaced apart leg members extends downwardly from the frame to support the frame in a horizontal configuration. A fabric material is stretched across the frame between the top, bottom, and side rails. The fabric material on the upper section defines a face opening configured to receive the face of a user when lounging in a face down position. The fabric material on the upper section defines a first arm opening adjacent a respective side rail and a second arm opening adjacent an opposed side rail. A platform is coupled to a front leg member adjacent the face opening and configured to support items to be viewed by a user through the face opening.

15 Claims, 6 Drawing Sheets

LOUNGE CHAIR EQUIPPED FOR FACE DOWN LOUNGING

BACKGROUND OF THE INVENTION

This invention relates generally to lawn furniture and, more particularly, to a lounge chair that is configured to support a user in a face down recumbent position without twisting his neck side to side.

Lounge chairs are often situated on a deck, patio, swimming pool area, beach, or the like to support users while relaxing, whether in the sun or shade. Some users desire to sunbathe in the sunshine while others may seek to rest in the shade and just enjoy being outdoors. In either case, traditional lounge chairs are typically configured to support a person lying on his or her back but are not specifically configured to comfortably support the user lying on his or her stomach. Specifically, attempting to lounge in a face down position typically requires the user to turn his head either to the left or to the right. Not only can this positioning result in neck discomfort but also to receiving an uneven amount of sun on one side of the user's face. Further, the user is unable to read a book or magazine while lying in a face down position.

Therefore, it would be desirable to have a lounge chair that is equipped for face down lounging in which the support surface defines a face opening configured to receive the user's face. Further, it would be desirable to have a lounge chair defining arm openings on either side of the face opening that are configured to receive the user's arms beneath the support surface. In addition, it would be desirable to have a lounge chair having a platform mounted beneath the face opening 42 configured to support reading material or electronic devices such that the user may read or work while lounging in a face down configuration.

SUMMARY OF THE INVENTION

A lounge chair equipped for lounging face down according to the present invention includes a frame having opposed top and bottom ends and opposed side rails extending longitudinally therebetween, the frame including lower, middle, and upper sections. A plurality of spaced apart leg members extends downwardly from the frame to support the frame in a horizontal configuration. A fabric material is stretched across the frame between the top, bottom, and side rails. The fabric material on the upper section defines a face opening configured to receive the face of a user when lounging in a face down position. The fabric material on the upper section defines a first arm opening adjacent a respective side rail and a second arm opening adjacent an opposed side rail. A platform is coupled to a front leg member in general alignment with the face opening and configured to support items to be viewed by a user lying face down on the fabric material.

Therefore, a general object of this invention is to provide a lounge chair that is equipped to support a user lying in either a face up or face down orientation.

Another object of this invention is to provide a lounge chair, as aforesaid, having a face opening configured to receive the face of a user lying face down on fabric material support surface.

Still another object of this invention is to provide a lounge chair, as aforesaid, defining opposed arm openings situated on respective sides of the face opening and adjacent respective sides of the lounge chair frame.

Yet another object of this invention is to provide a lounge chair, as aforesaid, that includes a platform beneath the face opening that is configured to support items that a user wishes to view while reclining in a face down position.

A further object of this invention is to provide a lounge chair, as aforesaid, having one or more headrest cushions to selectively cover the face opening so that a user may recline in a face up position without the user's head being received in the face opening.

A still further object of this invention is to provide a lounge chair, as aforesaid, that is easy to use and economical to manufacture.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

A lounge chair equipped for face down lounging will now be described with reference to FIGS. 1*a* to 6*b* of the accompanying drawings. The lounge chair 10 includes a frame 20, a supporting fabric material 40, and a face opening 42.

Figure 1A:
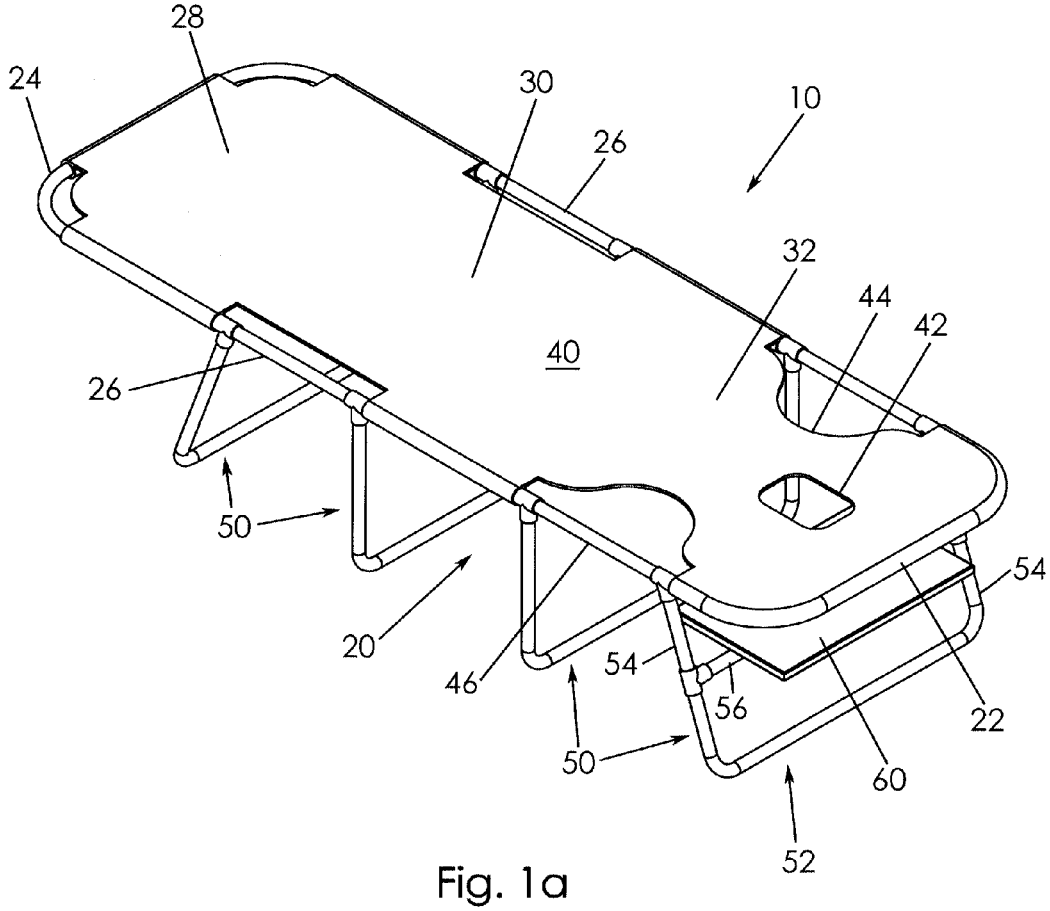
FIG. 1*a* is a perspective view of a chair lounger equipped for face down lounging according to a preferred embodiment of the present invention.
Figure 1B:
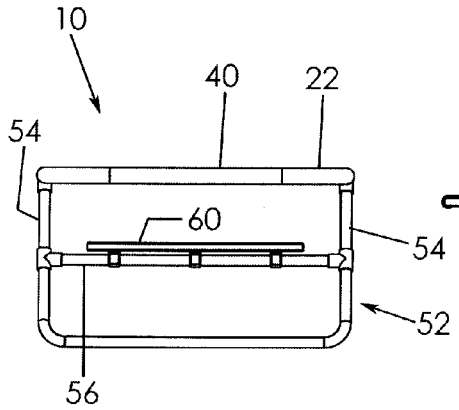
FIG. 1*b* is a front view of the chair lounger as in FIG. 1*a;*
Figure 1C:
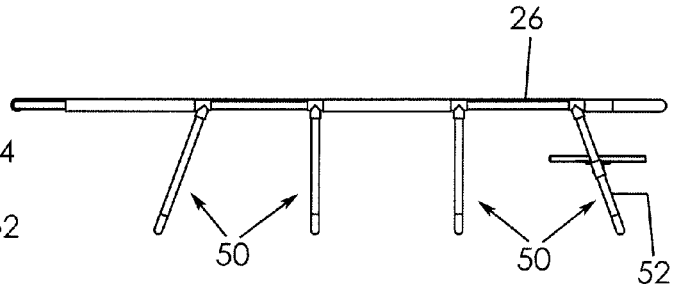
FIG. 1*c* is a side view of the chair lounger as in FIG. 1*a;*
Figure 2:
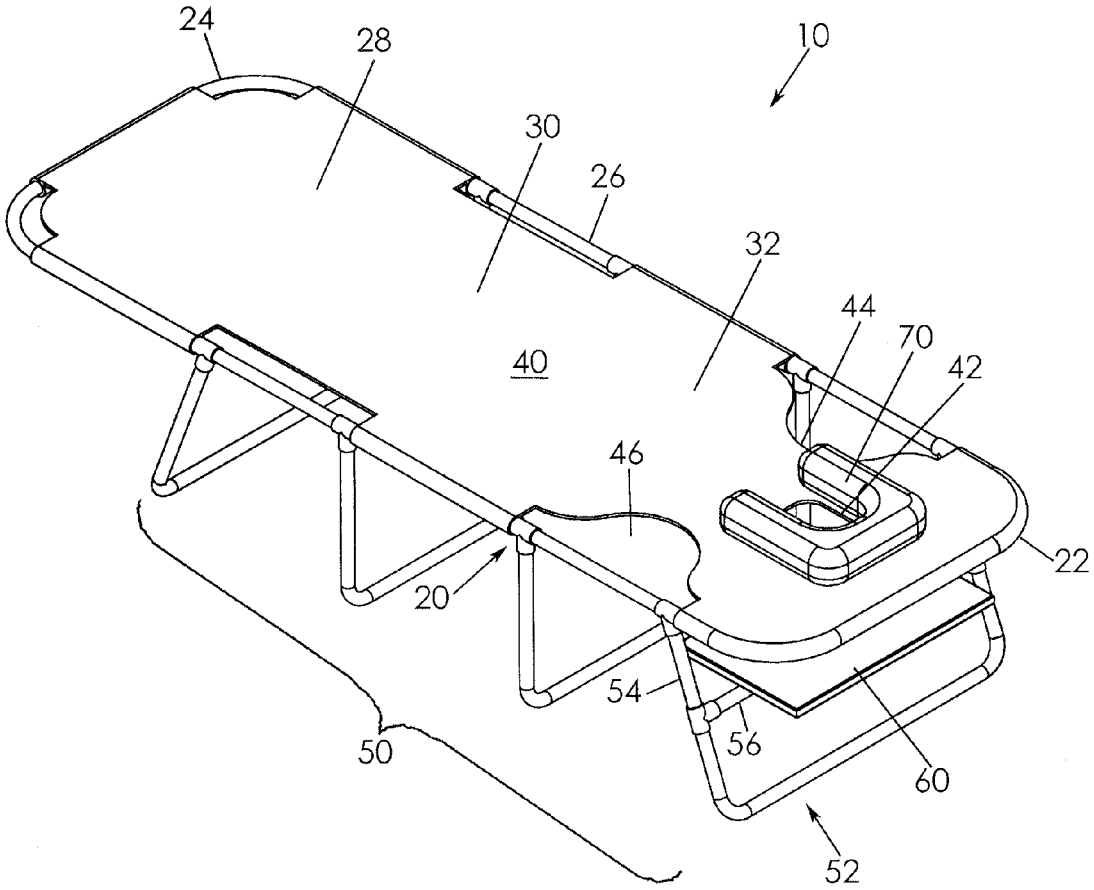
FIG. 2 is a perspective view of the chair lounger as in FIG. 1 with a headrest.

The frame 20 includes opposed top 22 and bottom 24 end rails with opposed side rails 26 extending longitudinally between respective ends of the top 22 and bottom 24 end rails (FIG. 1*a*). The frame 20 may define a generally rectangular configuration although other variations may also be suitable. The frame 20 may be segmented into sections; namely, the frame 20 may include a lower section 28 adjacent the frame bottom end rail 24, an upper section 32 adjacent the frame top end rail 22, and a middle section 30 intermediate the lower 28 and upper 32 sections. The side rails 26 may include pivotal couplings (i.e. pivot points) between the sections such that the upper section 32 may be pivotally movable relative to the middle section, the lower section 28 may be pivotally movable relative to the middle section, and so on as is known in the art.

A supportive fabric material 40 may be stretched between the frame side rails 26 substantially between the top 22 and bottom 24 end rails and configured to provide a strong support surface for supporting a sitting or recumbent person (FIG. 1*a*). Preferably, the fabric material is constructed of a soft and breathable material. The fabric material 40 extending across the upper section 32 of the frame 20 may define a face opening 42 configured to receive the face of a user when lying face down on the fabric material 40. The edges of the fabric material 40 defining the face opening 42 may be referred to herein as "circumferential edges." The fabric material 40 may also define a pair of arm openings through which a user may extend his arms when lying face down on the fabric material 40. More particularly, the fabric material 40 may define a first arm opening 44 adjacent one frame side rail 26 and a second arm opening 46 adjacent the opposite frame side rail 26. The arm openings 44, 46 are generally positioned laterally adjacent the face opening 42; in other words, the face opening 42 is situated between the first 44 and second 46 arm openings. Each arm opening may have an inwardly annular configuration and be large enough to receive a user's arm therethrough without difficulty. The arm openings are useful to enable a user to rest his arms on the floor or ground beneath the fabric material or to manipulate a book or magazine as will be described later.

Figure 4A:
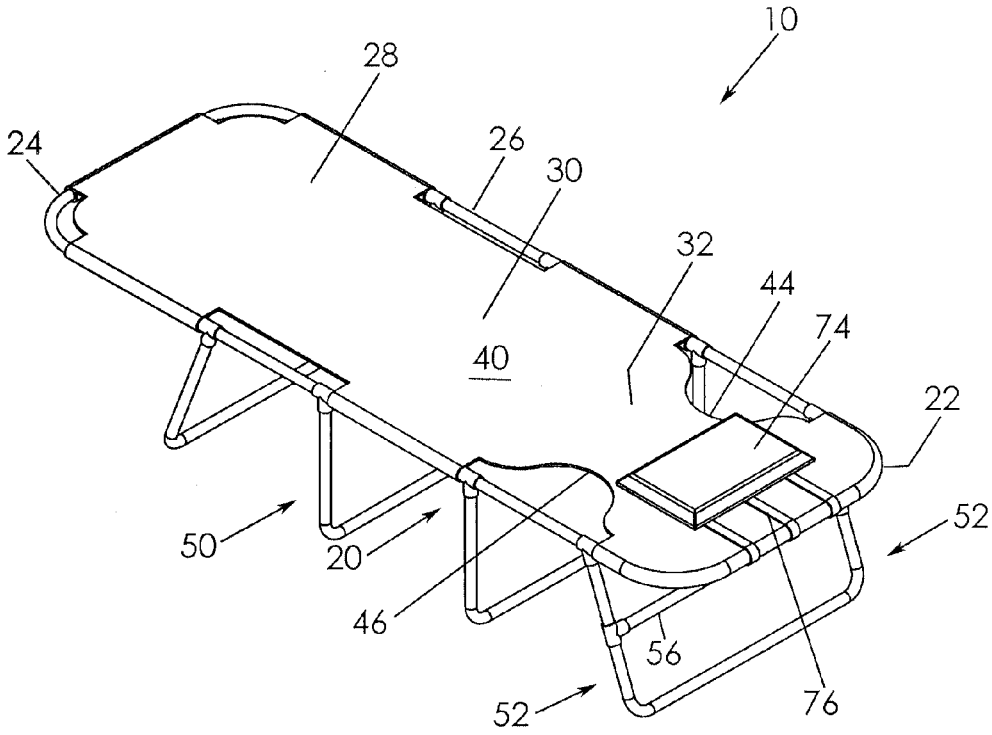
FIG. 4*a* is a perspective view of the chair lounger as in FIG. 1*a* with still another headrest in a configuration covering the face opening.

The lounge chair 10 includes a plurality of leg members 50 coupled to the side rails and extending downwardly therefrom, the leg members 50 preferably being spaced apart from one another so as to be capable of supporting the weight of a person sitting or lying on the support fabric material 40 (FIG. 1*a*). The leg members 50 may be pivotally coupled to the frame 20 and movable between retracted and extended configurations. In the retracted configuration (not shown), the leg members 50 are generally folded against or substantially parallel to the fabric material 40 such that the lounge chair 10 is more easily stored or transported. In the extended configuration shown in the drawings, the leg members 50 are substantially perpendicular relative to the fabric material 40 so as to support the lounge chair 10 above a ground surface. The leg member situated beneath and supporting the upper section 32 of the frame 20 may also be referred to as a "front" leg member 52. The front leg member 52 includes a pair of opposed support legs 54 and a support bar 56 extending between the support legs (FIG. 4*a*). Preferably the support bar 56 is situated about midway between the fabric material 40 and the free end of the front leg member 52.

The lounge chair 10 may include a platform 60 mounted atop the support bar 56 that spans between support legs 54 of the first leg 52 and includes a generally planar configuration capable of supporting a book, magazine, electronic device, or the like (FIG. 1*a*). The platform 60 may be fixedly connected to the support bar 56, such as with clamps, bolts, screws, or other fasteners. Alternatively, the platform 60 may be adjustably mounted such that its angle may be selectively adjusted. In addition, the platform 60 may be removably attached to the support bar 56 so that it may be removed for storage purposes.

Figure 3:
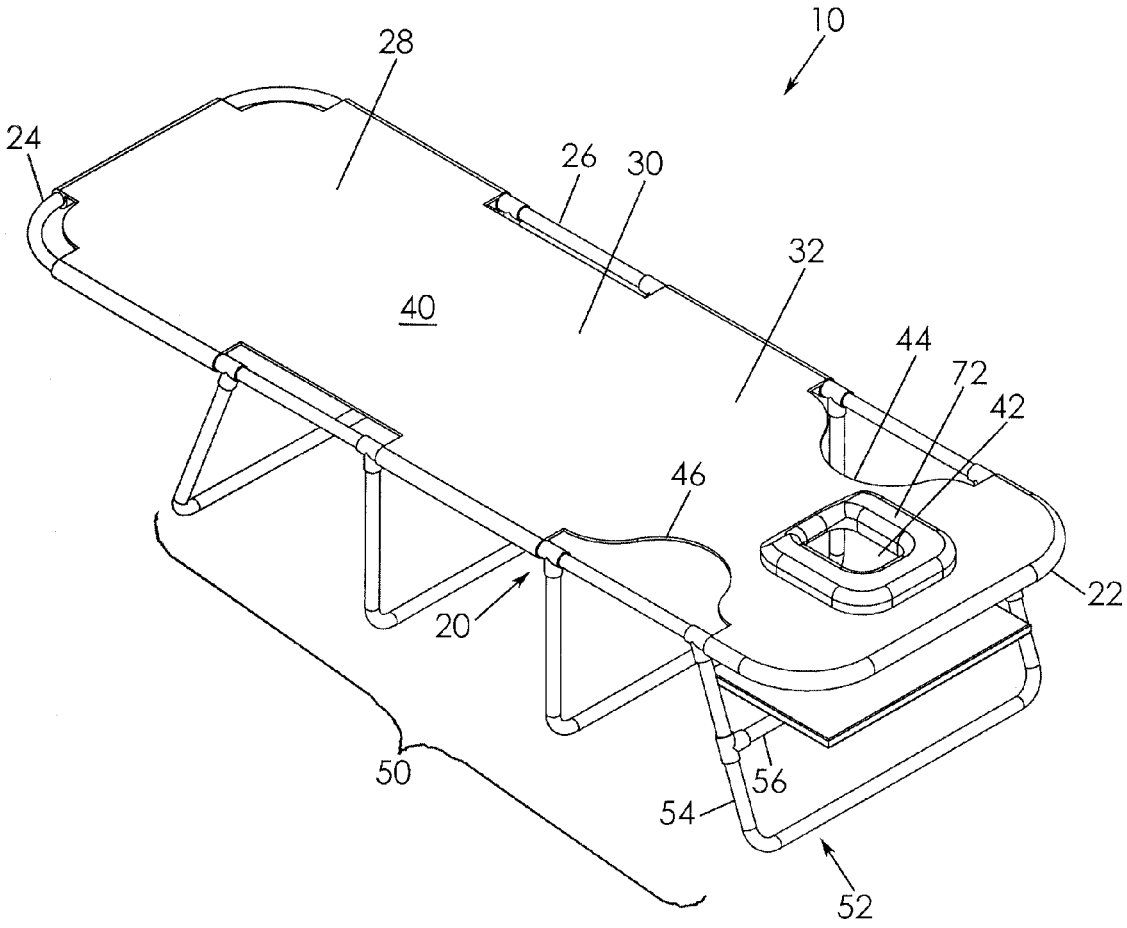
FIG. 3 is a perspective view of the chair lounger as in FIG. 1*a* with another headrest.

The lounge chair 10 may also include one or more headrests configured to surround or cover the face opening 42. One such headrest is a padded cushion 70 shown in FIG. 2 that includes a generally U-shaped configuration dimensioned to surround at least three side edges of the face opening 42. More particularly, the U-shaped padded cushion may include three segments of foam or other padded material that would comfortably receive a person's head while lying on the fabric material 40 in either a face down or face up recumbent position. Similarly, another headrest may be a padded cushion 72 as shown in FIG. 3 having a generally square configuration to surround four side edges of the face opening 42. More particularly, the padded cushion 72 may include four segments of foam or other padded material with one segment having a sloped configuration complementary to receiving a person's neck when lying on his back.

Figure 4B:
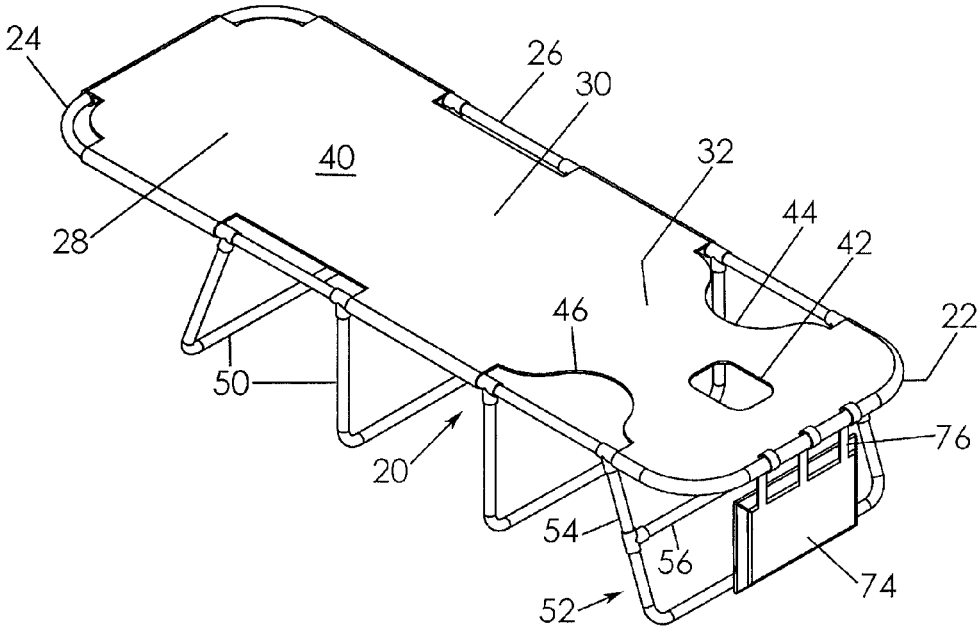
FIG. 4*b* is another perspective view of the chair lounger as in FIG. 1*a* with the headrest in a configuration uncovering the face opening.

Alternatively, the headrest may be in the form of a pillow 74 configured to completely cover the face opening 42 (FIG. 4*a*). Preferably, the pillow 74 may include a generally conventional rectangular configuration although other shapes may also be suitable. The pillow 74 may be constructed of foam or other padded material and may include beveled edges complementary to the contour of a user's neck. The pillow 74 may be pivotally coupled to the frame 20, such as the top end rail 22 with straps 76 or similar fasteners such that it may be conveniently moved between a position covering the face opening 42 (FIG. 4*a*) and a position exposing the face opening (FIG. 4*b*).

Figure 5A:
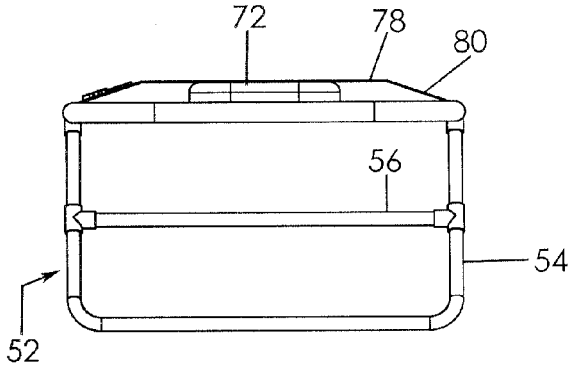
FIG. 5*a* is a front view of the chair lounger as in FIG. 1*a* with a hammock positioned to cover a padded cushion.
Figure 5B:
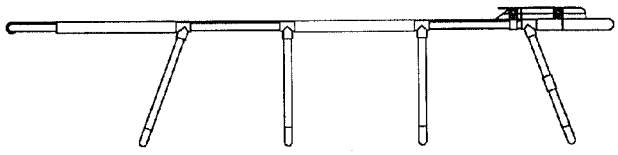
FIG. 5*b* is a side view of the chair lounger as in FIG. 5*a;*
Figure 5C:
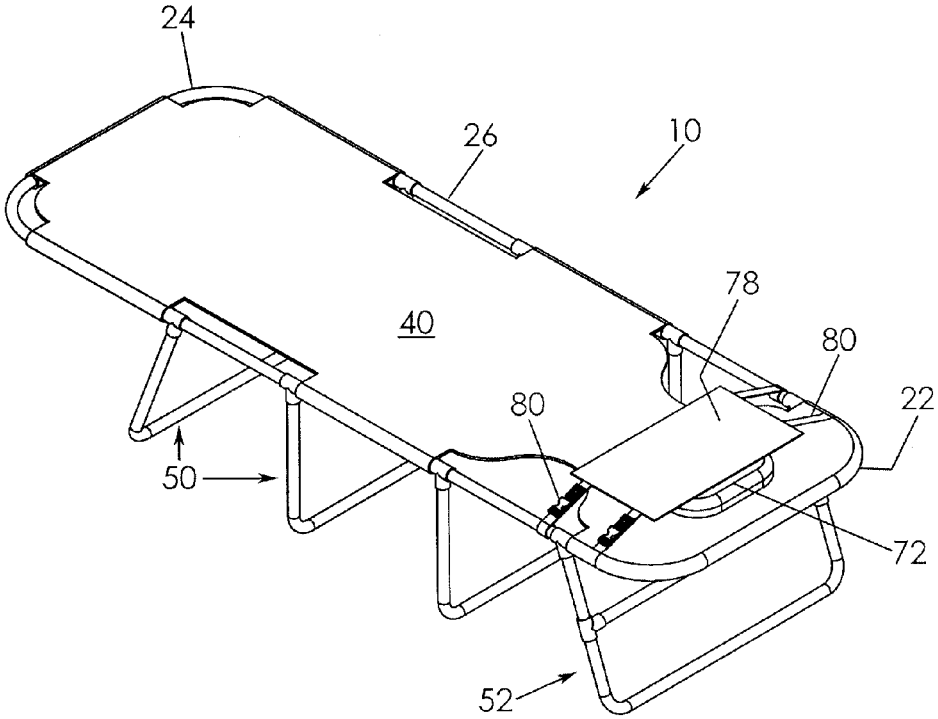
FIG. 5*c* is a perspective view of the chair lounger as in FIG. 5*a;*
Figure 6A:
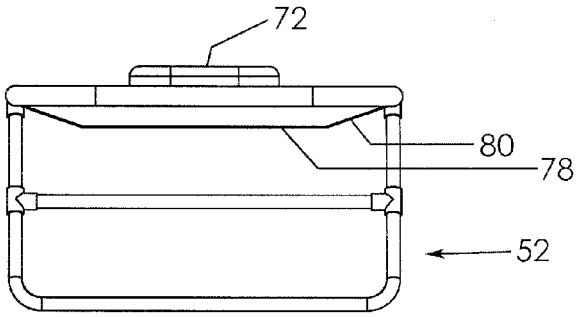
FIG. 6*a* is a front view of the chair lounger as in FIG. 5*a* but with the hammock positioned beneath the fabric material.
Figure 6B:
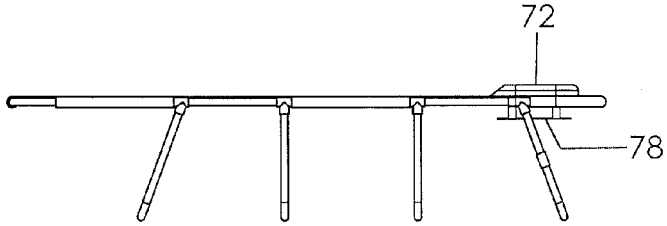
FIG. 6*b* is a side view of the chair lounger as in FIG. 6*a*.
Figure 6C:
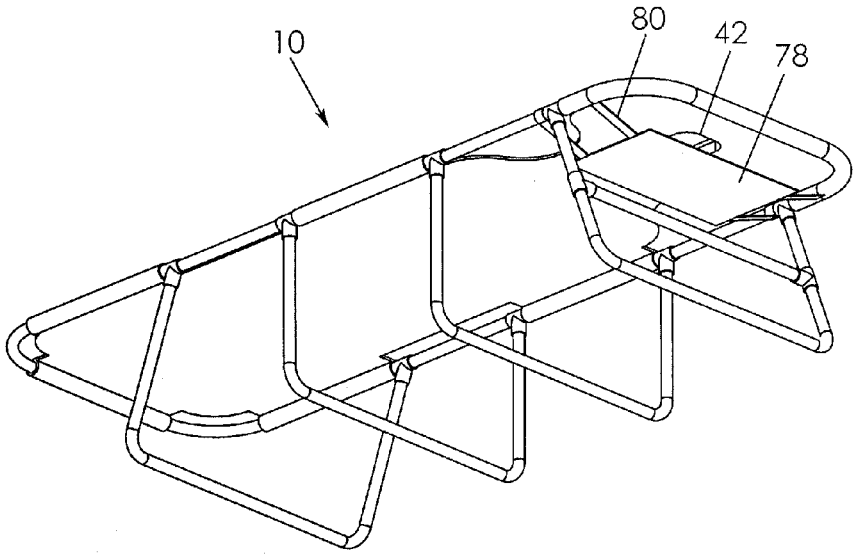
FIG. 6*c* is a perspective view of the chair lounger as in FIG. 6*a.*

Still another headrest includes a stretchable and flexible hammock 78 that includes straps 80 configured to couple the hammock 78 to the frame 20. The hammock 78 may then be situated to cover a head cushion, such as cushion 72, such that a user may lie on his back, resting his head on the hammock 78 which sinks down comfortably into an interior space of the cushion 72 (FIGS. 5*a* to 5*c*). Alternatively, the hammock 78 may be coupled to the frame 20 and positioned to extend beneath the fabric material 40 (FIGS. 6*a* 6*b*, and 6*c*). In this way, the hammock 78 may be used as a shelf or pouch to hold articles such as keys, cell phones, reading material, or the like while a user is reclining on the lounge chair.

In use, the lounge chair 10 may be set up with the legs 50 extended to support the fabric material 40 in a horizontal configuration suitable to support a recumbent person. If no headrest is desired so as to cover the face opening 42 while lying on one's back, then the user may lay face down with his face received in the face opening 42. While lying facedown, the user may extend his arms through the first 44 and second 46 arm openings. Extending one's arms through the openings not only provides comfort to the user, but enables him to hold or manipulate a book or magazine while viewing it through the face opening 42. The platform 60 positioned beneath the fabric material 40 is configured to support a book, magazine, or the like. The user is able to turn pages or otherwise manipulate the item on the platform 60 in that his arms may be extended beneath the lounge chair through the arm openings. When a user desires to recline face up, the face opening 42 may be covered with one of the headrest members described above.

It is understood that while certain forms of this invention have been illustrated and described, it is not limited thereto except insofar as such limitations are included in the following claims and allowable functional equivalents thereof.

What is claimed is:

1. A lounge chair equipped for face down lounging, comprising:

a frame having opposed top and bottom end rails and opposed side rails extending longitudinally between said top and bottom end rails, said frame including a lower section adjacent said bottom end rail, an upper section adjacent said top end rail, and a middle section intermediate said lower and upper sections;

a plurality of leg members extending downwardly from said frame and spaced apart from one another so as to support said frame upon a surface in a generally horizontal configuration;

a fabric material stretched across and attached to said frame between said top and bottom end rails and between said opposed side rails, said fabric material configured to support a person thereon;

wherein said fabric material on said upper section of said frame defining a face opening having a configuration to receive the face of a user reclining on said fabric material in a face down position;

wherein said fabric material on said upper section defines a first arm opening adjacent a respective side rail of said frame and a second arm opening adjacent an opposed respective side rail of said frame opposite said first arm opening;

wherein one of said plurality of leg members is a front leg member positioned beneath said upper section of said frame, said front leg member having opposed support legs extending downwardly from respective side rails of said frame and having a support bar extending linearly between said support legs and situated about midway between said fabric material and the free end of the front leg member;

wherein said support bar is situated directly beneath said face opening; and a platform coupled to and situated atop said support bar, said platform configured to be generally parallel to said upper section and beneath said face opening.

2. The lounge chair as in claim 1, wherein said platform is fixedly coupled to said support bar.

3. The lounge chair as in claim 1, wherein said platform is removably and adjustably coupled to said support bar.

4. The lounge chair as in claim 1, wherein said plurality of legs are pivotally coupled to said frame and movable between an extended configuration extending away from said frame and a retracted configuration generally parallel to said frame.

5. The lounge chair as in claim 1, further comprising a padded cushion having a configuration to surround at least three sides of said face opening when removably positioned on said fabric material adjacent said face opening.

6. The lounge chair as in claim 5, further comprising a hammock having a stretchable configuration that includes straps configured to be removably coupled to said frame and selectively movable between a first configuration in which said straps are coupled to said frame and said hammock is situated to cover said cushion so as to conform to a configuration of said cushion when a user's head rests thereupon and a second configuration in which said straps are coupled to said frame and said hammock is situated beneath said support fabric so as to create a pouch for selectively supporting articles therein.

7. The lounge chair as in claim 1, further comprising a padded cushion having a configuration to surround all circumferential edges of said face opening when removably positioned on said fabric material adjacent said face opening.

8. The lounge chair as in claim 7, further comprising a hammock configured to be removably coupled to said frame and situated atop said cushion, said hammock having a stretchable configuration that conforms to a configuration of said cushion when a user's head rests upon it.

9. The lounge chair as in claim 8, wherein said hammock is positioned to extend beneath said support fabric when coupled to said frame and is configured to support articles therein.

10. The lounge chair as in claim 1, wherein said platform is selectively removably coupled to said support bar and selectively removably coupled said opposed side rails of said frame so as to be positioned atop a top surface of said fabric material.

11. The lounge chair as in claim 1, further comprising a cushion pivotally coupled to a top end of said upper section of said frame and movable between a first configuration covering said face opening and a second configuration exposing said face opening.

12. A lounge chair equipped for face down lounging, comprising:

a frame having opposed top and bottom end rails and opposed side rails extending longitudinally between said top and bottom end rails, said frame including a lower section adjacent said bottom end rail, an upper section adjacent said top end rail, and a middle section intermediate said lower and upper sections;

a plurality of leg members extending downwardly from said frame and spaced apart from one another so as to support said frame upon a surface in a generally horizontal configuration wherein one of said plurality of leg members is a front leg member positioned beneath said upper section of said frame, said front leg member having opposed support legs extending downwardly from respective side rails of said frame and having a support bar extending linearly between said support legs;

a fabric material stretched across and attached to said frame between said top and bottom end rails and between said opposed side rails, said fabric material configured to support a person thereon;

wherein said fabric material on said upper section of said frame defines:

a face opening having a configuration to receive the face of a user reclining on said fabric material in a face down position; and opposed first and second arm openings located adjacent respective side rails of said frame;

a platform situated atop said support bar, said platform configured to be generally parallel to said upper section and beneath said face opening;

a padded cushion having a configuration to surround at least three sides of said face opening when removably positioned on said fabric material adjacent said face opening; and a hammock configured to be removably coupled to said frame and situated atop said cushion, said hammock having a stretchable configuration that conforms to a configuration of said cushion when a user's head rests upon it.

13. The lounge chair as in claim 12, wherein said padded cushion has a configuration that surrounds all circumferential edges of said face opening when removably positioned on said fabric material adjacent said face opening.

14. The lounge chair as in claim 13, wherein said hammock is positioned to extend beneath said support fabric when coupled to said frame and is configured to support articles therein.

15. A lounge chair equipped for face down lounging, comprising:

a frame having opposed top and bottom end rails and opposed side rails extending longitudinally between said top and bottom end rails, said frame including a lower section adjacent said bottom end rail, an upper section adjacent said top end rail, and a middle section intermediate said lower and upper sections;

a fabric material stretched across and attached to said frame between said top and bottom end rails and between said opposed side rails, said fabric material configured to support a person thereon;

wherein said fabric material on said upper section of said frame defines:

a face opening having a configuration to receive the face of a user reclining on said fabric material in a face down position; and opposed first and second arm openings located adjacent respective side rails of said frame;

a plurality of leg members extending downwardly from said frame and spaced apart from one another so as to support said frame upon a surface in a generally horizontal configuration wherein one of said plurality of leg members is a front leg member positioned beneath said upper section of said frame, said front leg member having opposed support legs extending downwardly from respective side rails of said frame and having a support bar extending linearly between said support legs situated about midway between said fabric material and the free end of the front leg member;

wherein said support bar is situated directly beneath said face opening;

a platform coupled to and situated atop said support bar, said platform configured to be generally parallel to said upper section and beneath said face opening;

a padded cushion having a configuration to surround all circumferential edges of said face opening when removably positioned on said fabric material adjacent said face opening; and a hammock having a stretchable configuration that includes straps configured to be removably coupled to said frame and selectively movable between a first configuration in which said straps are coupled to said frame and said hammock is situated to cover said cushion so as to conform to a configuration of said cushion when a user's head rests thereupon and a second configuration in which said straps are coupled to said frame and said hammock is situated beneath said support fabric so as to create a pouch for selectively supporting articles therein.

* * * * *